United States Patent [19]

Bartholic

[11] 4,311,579

[45] Jan. 19, 1982

[54] PREPARATION OF FCC CHARGE BY SELECTIVE VAPORIZATION

[75] Inventor: David B. Bartholic, Watchung, N.J.

[73] Assignee: Engelhard Minerals & Chemicals Corporation, Edison, N.J.

[21] Appl. No.: 155,735

[22] Filed: Jun. 2, 1980

Related U.S. Application Data

[63] Continuation-in-part of Ser. No. 90,247, Nov. 1, 1979, Pat. No. 4,263,128, which is a continuation-in-part of Ser. No. 875,326, Feb. 6, 1978, abandoned.

[51] Int. Cl.[3] ..... C10G 11/18; C10G 9/18; C10G 51/04

[52] U.S. Cl. ..... 208/73; 208/50; 208/55; 208/120; 208/251 R; 422/144; 422/190; 422/223

[58] Field of Search ..... 208/73, 102, 127, 77, 208/50, 52–55; 422/141–147, 190, 223

[56] References Cited

U.S. PATENT DOCUMENTS

| | | | |
|---|---|---|---|
| 2,378,531 | 7/1945 | Becker | 208/91 |
| 2,462,891 | 3/1949 | Noll | 422/190 |
| 2,472,723 | 6/1949 | Peet | 208/91 |
| 2,871,184 | 1/1959 | Kunreuther | 422/144 |
| 3,743,593 | 7/1973 | Saxton | 585/634 |
| 3,886,060 | 5/1975 | Owen | 208/120 |
| 4,061,562 | 12/1977 | McKinney et al. | 585/634 |

*Primary Examiner*—Delbert E. Gantz
*Assistant Examiner*—G. E. Schmitkons

[57] ABSTRACT

Gasoline and a heavier fraction from selective vaporization of crude or residual petroleum stocks are separately supplied to a riser reactor of the FCC type. The crude or resid is contacted at low cracking severity with hot inert solids in a riser. The vaporized product is fractionated to provide a gasoline injected to the bottom of an FCC riser and a bottoms fraction introduced at a higher point in the FCC riser.

2 Claims, 2 Drawing Figures

PREPARATION OF FCC CHARGE BY SELECTIVE VAPORIZATION

CROSS REFERENCE TO RELATED APPLICATIONS

This application is a continuation-in-part of application Ser. No. 090,247 (U.S. Pat. No. 4,263,128) filed Nov. 1, 1979 as a continuation-in-part of application Ser. No. 875,326, filed Feb. 6, 1978 and now abandoned.

BACKGROUND OF THE INVENTION

The invention is concerned with increasing the portion of heavy petroleum crudes which can be utilized as catalytic cracking feed stock to produce premium petroleum products, particularly motor gasoline of high octane number, or as high quality heavy fuel. The heavy ends of many crudes are high in Conradson Carbon (sometimes reported as Ramsbottom Carbon) and metals which are undesirable in catalytic cracking feed stocks and in products such as heavy fuel. The present invention provides an economically attractive method for selectively removing and utilizing these undesirable components from whole crudes and from the residues of atmospheric and vacuum distillations, commonly called atmospheric and vacuum residua or "resids." The terms "residual stocks," "resids" and similar terminology will be used here in a somewhat broader sense than is usual to include any petroleum fraction remaining after fractional distillation to remove some more volatile components. In that sense "topped crude" remaining after distilling off gasoline and lighter is a resid. The undesirable CC (for Conradson Carbon) and metal bearing compounds present in the crude tend to be concentrated in the resids because most of them have low volatility. The terms "Conradson Carbon" and "Ramsbottom Carbon" have reference to the two most used tests for this undesirable constituent. Some difference in numerical values by the two tests may be found for the same sample, but generally the test results from either are indicative of the same characteristic.

When catalytic cracking was first introduced to the petroleum industry in the 1930's the process constituted a major advance in its advantages over the previous technique for increasing the yield of motor gasoline from petroleum to meet a fast growing demand for that premium product. The catalytic process produces abundant yields of high octane naphtha from petroleum fractions boiling above the gasoline range, upwards of about 400° F. Catalytic cracking has been greatly improved by intensive research and development efforts and plant capacity has expanded rapidly to a present day status in which the catalytic cracker is the dominant unit, the "workhorse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker are adversely affected.

Quality of heavy fuels such as Bunker Oil and heavy gas oil is also increasingly affected as it becomes necessary to prepare these from crudes of high CC, metals and salt contents.

The effect of higher Conradson Carbon in catalytic cracking is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, at least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottle-neck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. Excessive hydrogen also raises a bottle-neck problem. The lighter ends of the cracked product, butane and lighter, are processed through fractionation equipment to separate components of value greater than fuel to furnaces, primarily propane, butane and the olefins of like carbon number. Hydrogen, being incondensible in the "gas plant" occupies space as a gas in the compression and fractionation train and can easily overload the system when excessive amounts are produced by high metal content catalyst, causing reduction in carge rate to maintain the FCC Unit and auxiliaries operative.

In heavy fuels, used in stationary furnaces, turbines, marine and large stationary diesel engines, quality is a significant factor. For example, petroleum ash, particularly vanadium and sodium, attacks furnace refractories and turbine blades.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780°-840° F. During the long residence time at this temperature, the charge is converted to coke and distillate products taken off the top of the drum for recovery of "coker gasoline," "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for FCC charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts. It is often desirable to treat the gas oils by expensive hydrogenation techniques before charging to catalytic cracking or blending with other fractions for fuels. Coking does reduce metals and Conradson Carbon, but still leaves an inferior gas oil for charge to catalytic cracking.

Catalytic charge stock and fuel stocks may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked napththa. Low temperature, liquid phase sorption on catalytically inert silica gel is proposed by Shuman and Brace, Oil and Gas Journal, Apr. 6, 1953, page 113. See also U.S. Pat. Nos. 2,378,531, 2,462,891 and 2,472,723, cited in the said parent application Ser. No. 875,326, filed Feb. 6, 1978.

The above noted U.S. Pat. Nos. 2,462,891 (Noll) and 2,378,531 (Becker) utilize a solid heat transfer medium to vaporize and preheat catalytic cracking charge stock utilizing heat from a catalytic regenerator. The intent of those patentees is to vaporize the total quantity of a catalytic charge stock, although it is recognized that a heavy portion of the charge may remain in liquid state and be converted to vaporized products of cracking and coke by prolonged contact with the heat transfer material, a conversion related to the coking processes earlier noted.

U.S. Pat. No. 2,472,723 proposes the addition of an adsorptive clay to the charge for a catalytic cracking process. The clay is used on a "once-through" basis to adsorb the polynuclear aromatic compounds which are believed to be coke precursors and thus reduce the quantity of coke deposited on the active cracking catalyst also present in the cracking zone.

It is known to use solid heat transfer agents to induce extensive cracking of hydrocarbon charge stocks at the high temperatures and short reaction times which maximize ethylene and other olefins in the product. An example of such teachings is U.S. Pat. No. 3,074,878 to Pappas.

SUMMARY OF THE INVENTION

The invention is an improvement on the selective vaporization process and apparatus described in application Ser. Nos. 875,326; 090,247; and 144,477, filed Feb. 6, 1978; Nov. 1, 1979; and Apr. 28, 1980, respectively. The entire contents of the said prior applications are incorporated herein by this reference.

Briefly, the selective vaporization process is conducted by contacting a heavy charge stock such as whole crudes, topped crudes, resids and the like with an inert, finely divided solid material in a rising confined vertical column under conditions to deposit heavy components of high CC and/or metal content on the solid and vaporize other components of the charge. This results from temperatures high enough to cause the desired vaporization and very short hydrocarbon residence times to avoid substantial cracking. The operation is thus held to a low cracking severity to accomplish the desired purpose of separating vaporizable, more valuable components from those which are regarded as contaminants. Steam, light hydrocarbons or the like are added to the rising confined column in the selective vaporization facility to reduce partial pressure of hydrocarbons in the charge and thus aid in vaporization.

Vaporous hydrocarbons are separated at the top of the column from inert solids bearing the unvaporized components as a deposit thereon. The vapors are promptly quenched to a temperature below that at which substantial thermal cracking occurs and processed as desired in a catalytic cracker or the like.

The separated inert solids bearing the deposit of unvaporized components of the charge are transferred to a burner for combustion of the deposit in air or other oxygen containing gas. Heat generated by combustion of the deposit raises the temperature of the inert solids which are then returned to the lower portion of the rising confined column to supply the heat for selective vaporization of additional heavy charge.

According to the present invention, operation of a riser FCC Unit for cracking of the product from selective vaporization is improved by injecting the gasoline fraction from selective vaporization to the lower section of the FCC riser where it serves as carrier for the FCC catalyst and the gasoline is thereby upgraded. The heavier fraction from selective vaporization is introduced at a higher point in the FCC riser. This permits added flexibility in cracking of the heavy fraction boiling above about 400°–450° F. by providing variable residence time in the FCC riser. In addition, the low octane naphtha is subjected to contact with fresh FCC catalyst at high catalyst/oil ratios for conversion to LPG and high octane gasoline.

DESCRIPTION OF THE DRAWINGS

Apparatus suited to practice of the invention is illustrated diagrammatically in FIG. 1 of the annexed drawings.

DESCRIPTION OF SPECIFIC EMBODIMENTS

Figure 1:
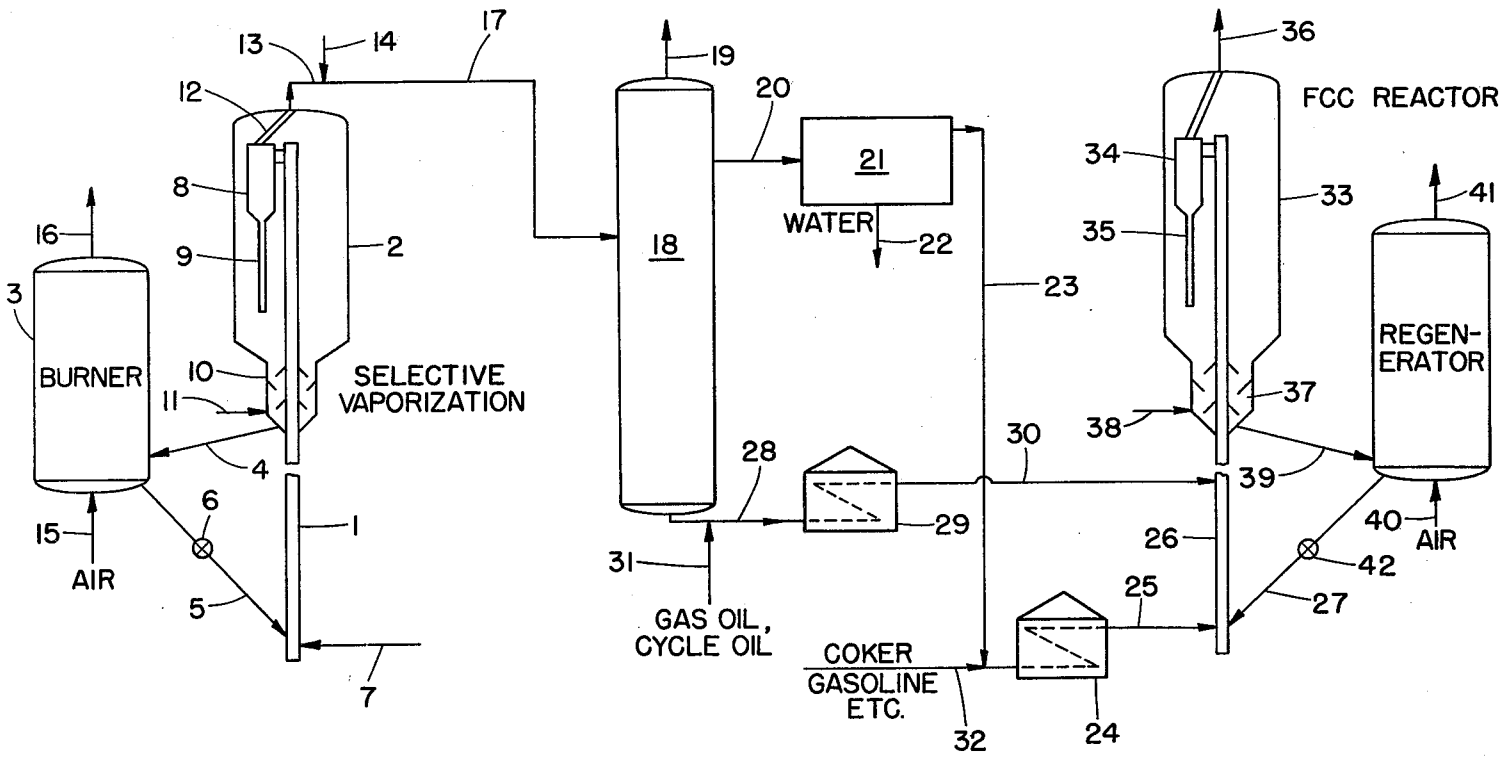

As shown in FIG. 1, the principal vessels used are a riser 1 for conducting the short time, high temperature contact between hot inert solids and charge stock which terminates in a disengaging chamber 2 from which inert solids bearing a deposit of unvaporized material are transferred to a burner 3 by standpipe 4. The hot inert solids resulting from combustion in burner 3 are returned to the base of riser 1 by a standpipe 5 through a control valve 6.

A charge stock containing high boiling components which are characterized by high CC, metals content or both is admitted to the riser 1 by line 7 to rise at high velocity in riser 1 while in intimate contact with the hot inert solids from standpipe 5. The major portion of the charge stock is vaporized at the temperature prevailing in the riser by reason of the hot solids from standpipe 5. That vaporization is extremely rapid to result in a rapidly rising column of vapor with inert solids suspended therein. The portions of the charge which are not vaporized coalesce on the inert solids to provide a combustible deposit constituted primarily by feed stock components of high CC and metals content.

The solids are separated from the vaporous hydrocarbons at the top of riser 1 by any of the systems developed for the same purpose in the well-known FCC process for riser cracking of hydrocarbons in the presence of an active cracking catalyst. A system of preference in the present invention is the vented riser described in Meyers, et al. U.S. Pat. Nos. 4,066,533 and 4,070,159. The upper end of riser 1 is open whereby inertia of the suspended solids causes them to be projected into the vessel 2. Vapors leave the riser through a side vent in the riser to cyclone separator 8 where solids still suspended in the vapors are removed and discharged by dip leg 9 to the lower portion of vessel 2. The solids projected from the top of riser 2 and those from dip leg 9 pass downwardly to a stripper 10 where steam from line 11 aids in vaporization of any remaining volatile hydrocarbons before the solids bearing combustible deposit enter standpipe 4 for transfer to burner 3.

The vapors separated from entrained solids in cyclone 8 pass by conduit 12 to transfer line 13 where the vapors are quenched to a temperature below that at which substantial thermal cracking occurs by mixture with a suitable quench medium such as a cold hydrocarbon stream or water.

The burner 3 may be any of the various structures developed for burning of combustible deposits from finely divided solids, for example, the regenerators for Fluid Cracking Catalyst. Air admitted to the burner 3 by line 15 provides the oxygen for combustion of the deposit on the inert solid, resulting in gaseous products of combustion discharged by flue gas outlet 16. The burner 3 is preferably operated to maintain the temperature in the burner at the maximum value, usually limited by metallurgy of the burner. This is accomplished by controlling temperature of the riser 1 to the minimum temperature which will provide the amount of fuel (as deposit on the inert solids) which will sustain the maximum temperature of the burner. As is common in heat balanced FCC Units, valve 6 is controlled responsive to the temperature at the top of riser 1 in a manner to maintain the riser temperature at a preset value. That preset temperature is reset as needed in selective vaporization to maintain a desired maximum temperature in burner 3. A trend to lower temperature in burner 3 is compensated by reduction of the preset temperature of riser 1, and vice versa. Inert solids heated by the combustion in burner 3 are stripped with steam in the burner 3 or the standpipe 5 before being returned to riser 1.

The solid contacting agent is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27 API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. Other suitable inert solids include coke from petroleum or coal and, in general, any solid which satisfies the stated criteria.

The microspheres of calcined kaolin clay preferably used in the process of the invention are known in the art and are employed as a chemical reactant with a sodium hydroxide solution in the manufacture of fluid zeolitic cracking catalysts as described in U.S. Pat. No. 3,647,718 to Haden et al. In practice of the instant invention, in contrast, the microspheres of calcined kaolin clay are not used as a chemical reactant. Thus the chemical composition of the microspheres of calcined clay used in practice of this invention corresponds to that of a dehydrated kaolin clay. Typically, the calcined microspheres analyze about 51% to 53% (wt.) $SiO_2$, 41 to 45% $Al_2O_3$, and from 0 to 1% $H_2O$, the balance being minor amounts of indigenous impurities, notably iron, titanium and alkaline earth metals. Generally, iron content (expressed as $Fe_2O_3$) is about ½% by weight and titanium (expressed as $TiO_2$) is approximately 2%.

The microspheres are preferably produced by spray drying an aqueous suspension of kaolin clay. The term "kaolin clay" as used herein embraces clays, the predominating mineral constituent of which kaolinite, halloysite, nacrite, dickite, anauxite and mixtures thereof. Preferably a fine particle size plastic hydrated clay, i.e., a clay containing a substantial amount of submicron size particles, is used in order to produce microspheres having adequate mechanical strength.

While it is preferable in some cases to calcine the microspheres at temperatures in the range of about 1600° F. to 2100° F. in order to produce particles of maximum hardness, it is possible to dehydrate the microspheres by calcination at lower temperatures; for example, temperatures in the range of 1000° F. to 1600° F., thereby converting the clay into the material known as "metakaolin." After calcination the microspheres should be cooled and fractionated, if necessary, to recover the portion which is in the desired size range, say 20–150 microns.

Pore volume of the microspheres will vary slightly with the calcination temperature and duration of calcination. Pore size distribution analysis of a representative sample obtained with a Desorpta analyzer using nitrogen desorption indicates that most of the pores have diameters in the range of 150 to 600 Angstrom units.

The surface area of the calcined microspheres is usually within the range of 10 to 15 $m^2/g$. as measured by the well-known B.E.T. method using nitrogen absorption. It is noted that the surface areas of commercial fluid zeolitic catalysts is considerably higher, generally exceeding values of 100 $m^2/g$. as measured by the B.E.T. method.

Although the system just described bears superficial resemblance to an FCC Unit, its operation is very different from FCC. Most importantly, the riser contactor 1 is operated to remove from the charge an amount not greatly in excess of the Conradson Carbon number of the feed. This contrasts with normal FCC "conversion" of 50–70%, measured as the percentage of FCC product not boiling within the range of the charge. Percent removed by the present process is preferably on the order of 10% to 20% on charge and constituted by gas, and deposit on the solid contacting agent. Rarely will the amount removed as gas, gasoline and deposit on the inert solid exceed a value, by weight, more than 3 to 4 times the Conradson Carbon value of the charge. This result is achieved by a very low severity of cracking due to inert character of the solid and the very short residence time at cracking temperature. As is well known, cracking severity is a function of time and temperature.

Increased temperature may be compensated by reduced residence time, and vice versa.

The new process affords a control aspect not avialable to FCC Units in the supply of hydrocarbons or steam to the riser contactor. When processing stocks of high CC, the burner temperature will tend to rise because of increased supply of fuel to the burner. This may be compensated by increased quantity, decreased temperature, or increasing the hydrocarbons or steam supplied to reduce partial pressure of hydrocarbons in the riser contactor or recycling water from the overhead receiver to be vaporized in the riser to produce steam.

The riser contact with inert solid thus provides a novel sorption technique for removing the polynuclear aromatic compounds of resids (high CC and metals) while these are carried in a stream of low hydrocarbon partial pressure by reason of hydrocarbons or steam supplied to the riser.

The decarbonized, desalted and/or demetallized resid is good quality FCC charge stock and may be transferred to the feed line of an FCC reactor operated in the conventional manner.

It is found that the nature of the selective vaporization is a function of temperature, total pressure, partial pressure of hydrocarbon vapors, residence time, charge stock and the like. One effect of temperature is a tendency to decrease the combustible deposit on the contact material as contact temperature is increased. Thus greater portions of the charge are vaporized at higher temperatures and the secondary effect of thermal cracking of deposited hydrocarbons increases at higher temperatures. These effects of higher temperature enhance the yield of product from the operation and reduce the fuel supplied to the combustion zone in the form of combustible deposit.

In general, the temperature of selective vaporization will be above the average boiling point of the charge stock, calculated as the sum of the 10% to 90% points by ASTM distillation of the charge divided by nine. For the heavy stocks contemplated by the invention, the contact temperature will usually be not substantially below 900° F. and will be below the temperatures at which severe cracking occurs to produce large yields of olefins. Thus even at residence times as short as 0.1 second or less, selective vaporization temperatures will be below about 1050° F.

Residence time for selective vaporization is not accurately calculated by the methods generally used in FCC cracking where the volume of vapors increases to a major extent as the hydrocarbons remain in contact with an active cracking catalyst along the length of a riser. In selective vaporization, the vapors are quickly generated on contact with the hot inert solid and remain substantially constant along the length of the riser, increasing slightly with modest thermal cracking believed to be cracking of the deposit on the inert solid. Residence time of hydrocarbons in selective vaporization is therefore calculated with reasonable accuracy as the length of the riser from point of hydrocarbon injection to point of disengagement from inert solids divided by superficial velocity of vapors (hydrocarbons, steam, etc.) at the top of the riser. So calculated, hydrocarbon residence time in selective vaporization will be not substantially greater than about 3 seconds and is preferably much shorter, one second or less, such as 0.1 second. As previously indicated, residence time and temperature will be correlated to provide conditions of low cracking severity. The quantity removed from the charge is very nearly equal to CC value of the charge when operating under preferred conditions and will rarely exceed a value 3 to 4 times the CC of the charge. Further, the hydrogen content of the deposit is about 3% to 6%, below the 7-8% normal in FCC coke.

According to the present invention, the selective vaporization product is fractionated and fractions of normally liquid hydrocarbons are introduced to an FCC riser at different points. The invention also provides a means to vary hydrocarbon residence time in the FCC riser while maintaining charge rate constant or to maintain a constant residence time at reduced charge rate. It will be apparent that the invention also provides other flexibilities for the process, i.e., residence times and/or charge rates may be varied without holding either at constant levels. The quenched selective vaporization product passes by transfer line 17 to a fractionation column 18 from which normally gaseous portions are taken overhead by line 19 to be processed in conventional manner, e.g., for refinery fuel. An intermediate gasoline fraction at line 20 passes to a settling drum 21 from which water is discharged at drain 22 and an upper layer of naptha is withdrawn by line 23 for supply to preheat furnace 24. The preheated naptha is supplied by line 25 to the bottom of FCC riser 26 where it meets hot catalyst from standpipe 27 and suspends the same as a rising confined column.

The bottoms fraction from column 18, constituted by selective vaporization product boiling above about 450° F. is transferred by line 28 to preheat furnace 29. The so preheated heavy fraction then passes by line 30 to be injected to riser 26 at a point above the naphtha injection as shown in FIG. 1. Other feed stocks for the FCC reactor, such as cycle oil, virgin gas oil and the like will be added by line 31 to transfer line 28.

The selective vaporization naphtha in line 23 may be supplemented by other low grade naphtha supplied by line 32. Such naphthas as coker gasoline, visbreaker gasoline and like fractions from steam cracking to make ethylene are contemplated for this purpose, recognizing that the latter may require preliminary hydrogenation to reduce the amount of highly reactive diolefins and the like.

Except for the use of thermally cracked gasoline as a lift gas and feed stock at the bottom of the riser 26, operation of the FCC Unit is essentially conventional. Products of FCC cracking are separated from catalyst at the top of riser 26, which again may be of the vented riser type earlier discussed. Catalyst is ejected from the open upper end of riser 26 into vessel 33 while vapors are diverted to cyclone separator 34 for separation of suspended catalyst into dip leg 35 and return to vessel 33. The product vapors pass from cyclone 34 to transfer line 36 for fractionation.

The separated catalyst in vessel 33 including that ejected from the open top of riser 26 and that from dip leg 35 fall through a stripper 37 at the bottom of vessel 33 where volatile hydrocarbons are vaporized by the aid of steam admitted through line 38. Stripped catalyst passes by standpipe 39 to a regenerator of any suitable type for combustion of coke on the catalyst by air injected at line 40. Flue gas from the combustion of the coke on catalyst is discharged at flue 41 and the hot regenerated catalyst is returned to the riser by standpipe 27 through valve 42.

In its broader aspects, the invention contemplates injection of any thermally cracked gasoline to the bottom of an FCC riser reactor and injection thereabove of heavier charge boiling upwards of 450° F. All such operations will convert the low octane gasoline to LPG and high octane gasoline over freshly regenerated catalyst at high catalyst/oil ratios. Further, the thermal gasoline provides a lift gas which is compatible with cracking catalyst. It is noted that use of steam for that purpose could severely damage the catalyst due to the adverse effect of high steam concentration at high temperature.

Figure 2:
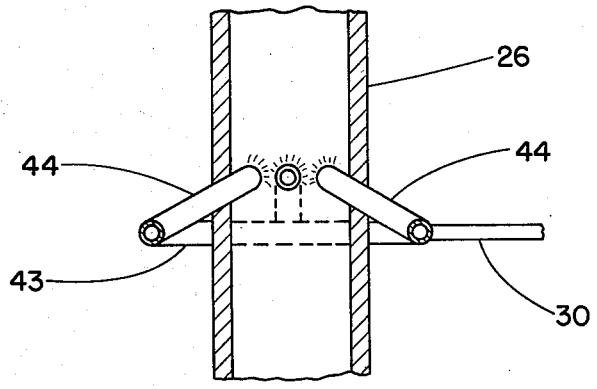
FIG. 2 represents a preferred style of injection nozzle contemplated for use in injecting charge stock to the FCC riser at a point above the point for introduction of selective vaporization gasoline.

A preferred system for injection of the heavy fraction from line 30 is shown in FIG. 2. Charge stock from line 30 is supplied to a ring manifold 43 about the riser 26. A plurality of nozzles 44 (four in the embodiment shown), arranged symmetrically about the center line of riser 26 transfer the charge stock into riser 26 where it is projected upwardly into the rising column of catalyst carried upwardly by the gasoline injected from line 25 together with conversion products of that gasoline. The several nozzles 44 are directed inwardly and upwardly of riser 26 in such manner that the injected streams from the nozzles intersect at a common point approximately on the center line of the riser.

I claim:

1. In a process for preparing premium products from crude petroleum by fractionally distilling the crude petroleum to separate gasoline and distillate gas oil from a residual fraction having a substantial Conradson Carbon number and charging the distillate gas oil to catalytic cracking, contacting said residual fraction in a rising confined vertical column with an inert solid material having a microactivity for catalytic cracking not substantially greater than 20 at low severity, including a temperature of at least about 900° F. for a period of time less than two seconds and less than that which induces substantial thermal cracking of said residual fraction, at the end of said period of time separating from said inert solid a decarbonized residual fraction of reduced Conradson Carbon number as compared with said residual fraction, reducing temperature of the said separated fraction to a level below that at which substantial thermal cracking takes place and adding said decarbonized residual fraction to said distillate gas oil as additional charge to said catalytic cracking; the improvement which comprises fractionating said reduced temperature separated fraction to provide a normally liquid naphtha fraction boiling below about 450° F. and a heavy fraction having a boiling range above that of said naphtha fraction, injecting said naphtha fraction to the bottom of a catalytic cracking riser reactor to produce a rising confined column of hydrocarbons in said reactor, injecting a finely divided active cracking catalyst to said reactor and dispersing the said catalyst in said rising confined column of hydrocarbons, injecting said heavy fraction to the rising confined column of catalyst dispersed in hydrocarbons at a point spaced above the injection of said naptha fraction and separating vaporous products of catalytic cracking from catalyst at the top of said riser reactor.

2. A process according to claim 1 wherein said severity is at a level such that the quantity of said decarbonized residual fraction is less than said residual fraction by a weight percent no greater than twice said Conradson Carbon number.

* * * * *